United States Patent [19]

Danahy

[11] 4,058,076

[45] Nov. 15, 1977

[54] HULL FOILS WITH HYDRODYNAMIC RIGHTING FORCES

[76] Inventor: Philip J. Danahy, 12801 Prestwick Drive, Oxon Hill, Md. 20022

[21] Appl. No.: 720,077

[22] Filed: Sept. 2, 1976

[51] Int. Cl.[2] ..... B63B 1/28

[52] U.S. Cl. ..... 114/281; 114/129; 114/140

[58] Field of Search ..... 114/123, 127, 129, 140–142, 114/271, 274–284

[56] References Cited

U.S. PATENT DOCUMENTS

| | | | |
|---|---|---|---|
| 2,749,869 | 6/1956 | Bush | 114/280 |
| 2,749,871 | 6/1956 | Scherer et al. | 114/276 |
| 2,890,671 | 6/1959 | Hobday | 114/275 |
| 2,926,623 | 3/1960 | Leehey | 114/274 |
| 3,651,775 | 3/1972 | Kock | 114/274 |
| 3,763,811 | 10/1973 | Danahy | 114/279 |
| 3,961,590 | 6/1976 | Kefalos | 114/123 |

*Primary Examiner*—Trygve M. Blix
*Assistant Examiner*—Stuart M. Goldstein
*Attorney, Agent, or Firm*—Clarence A. O'Brien; Harvey B. Jacobson

[57] ABSTRACT

A boat is provided having front and rear ends, a bottom and upwardly projecting sides extending upwardly to an elevation spaced above the static water line of the boat. A depending central strut (fixed or upwardly retractable) projects downwardly from the bottom and a pair of elongated downwardly convergent opposite side flexible foils including leading and trailing longitudinal edges facing in front and rear directions, respectively, of the boat are provided and have their lower ends anchored to the lower end portion of the strut. The upper end portions of the foils are anchored relative to upper portions of the corresponding sides of the boat above the static water line thereof outwardly of the boat sides and the foils are free of support from the boat intermediate the upper and lower ends of the foils.

15 Claims, 13 Drawing Figures

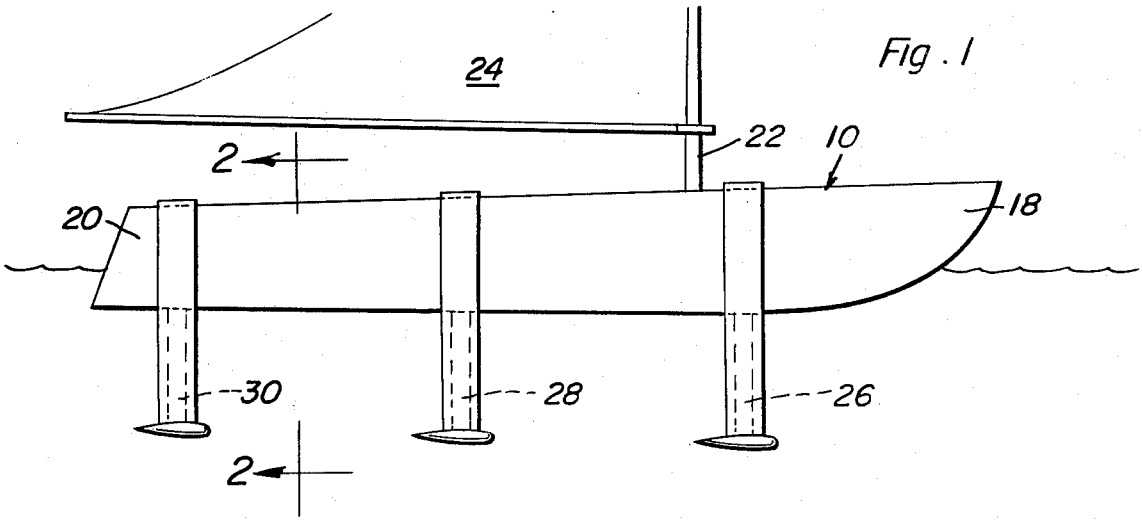
Fig. 1
Fig. 2
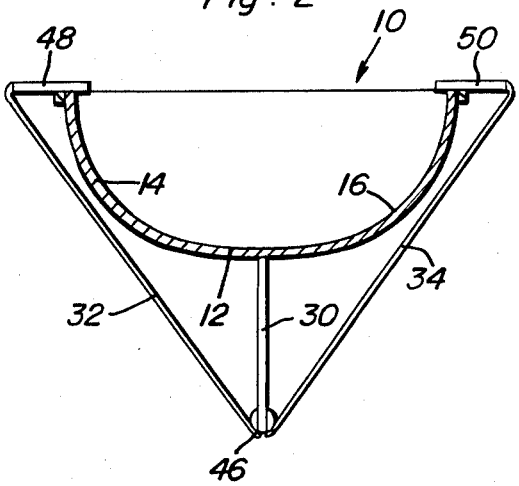
Fig. 3
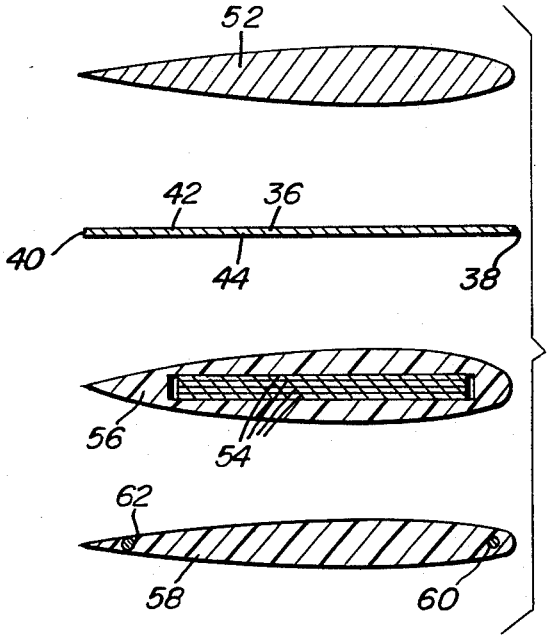
Fig. 4
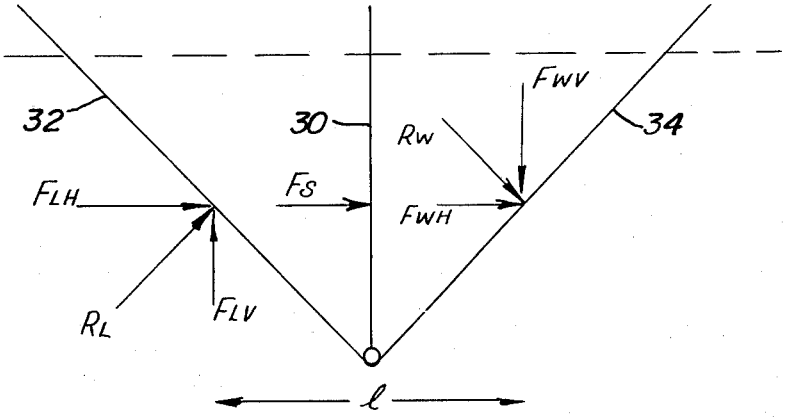

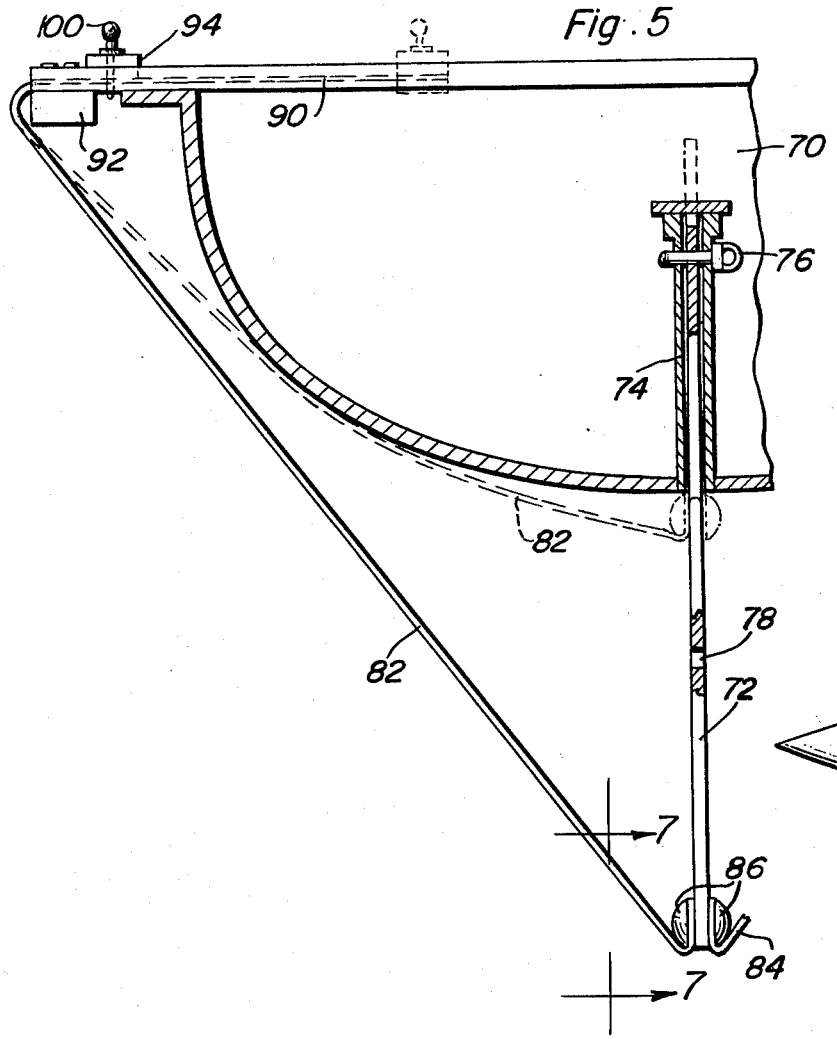
Fig. 5
100
94
90
92
70
76
74
82
78
72
7
86
84
7
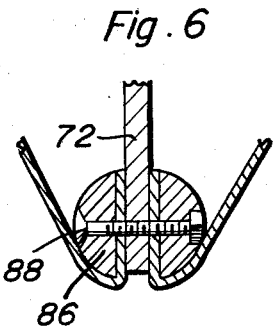
Fig. 6
72
88
86
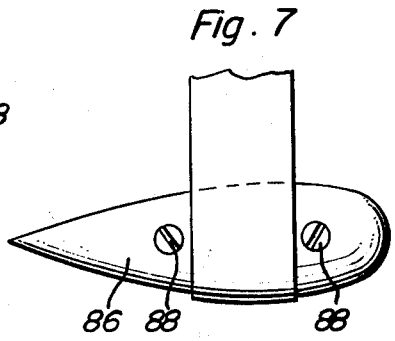
Fig. 7
86
88
88
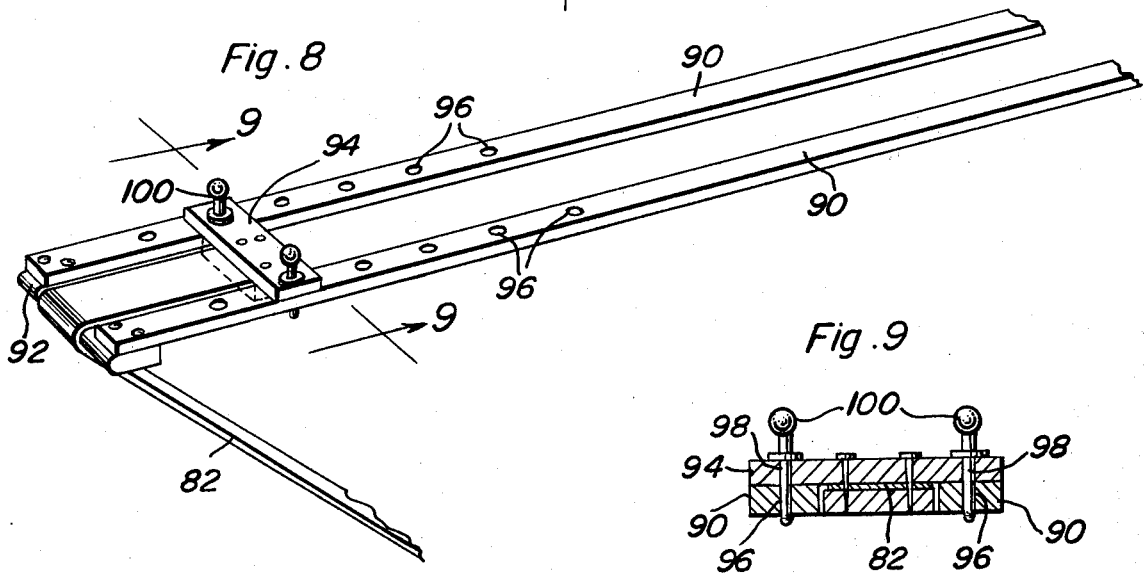
Fig. 8
90
96
9
94
100
90
96
9
92
82
Fig. 9
100
98
98
94
90
90
96
82
96

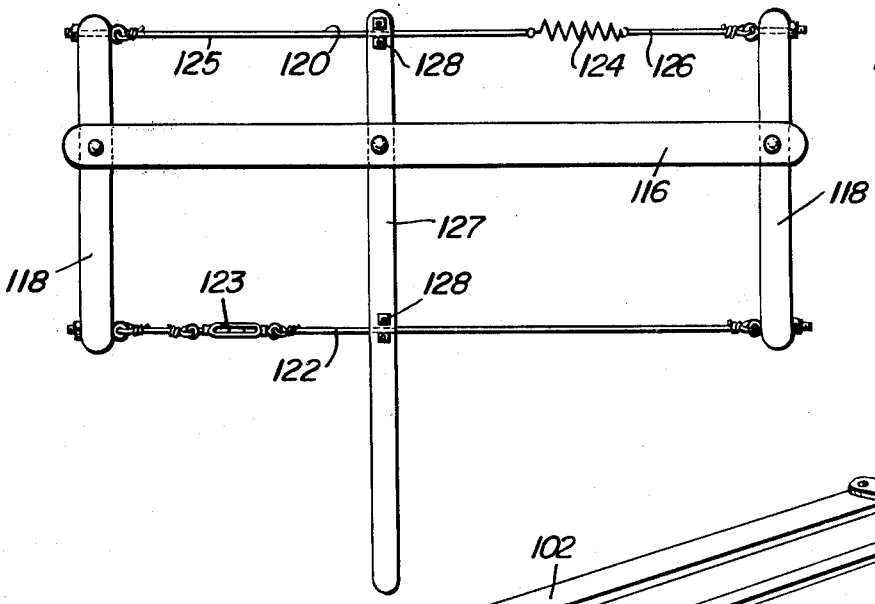
Fig. 11
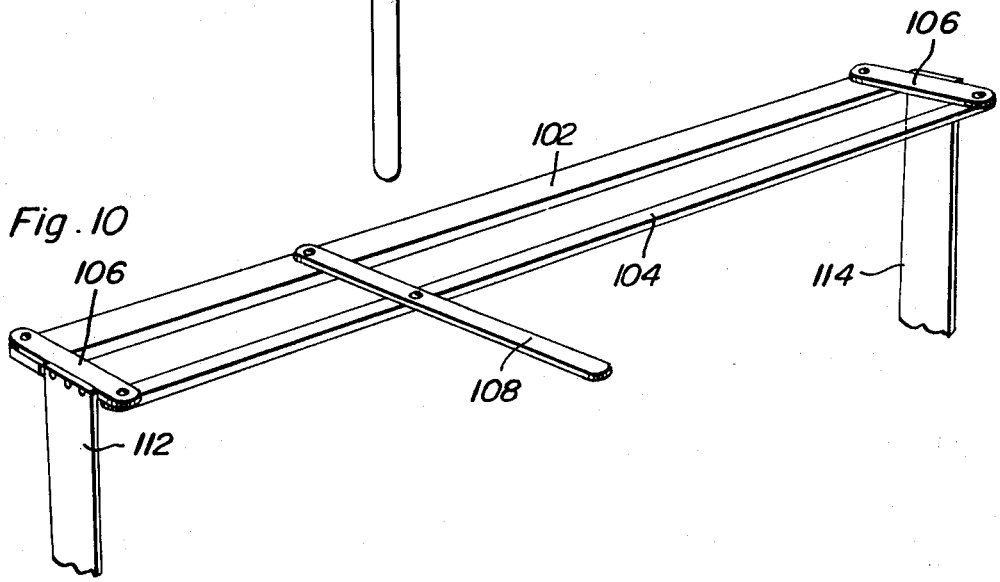
Fig. 10
Fig. 12
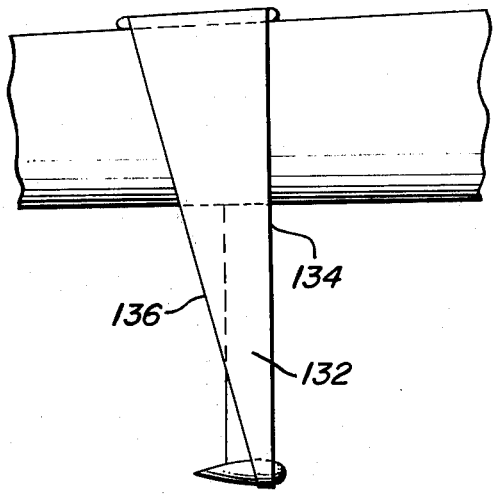
Fig. 13
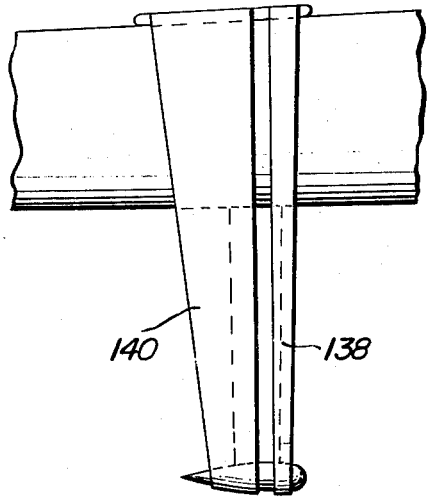

HULL FOILS WITH HYDRODYNAMIC RIGHTING FORCES

BACKGROUND OF THE INVENTION

Various forms of flexing hydrofoils and downwardly convergent hydrofoils have been provided for different types of boat hulls. However, of those previously known forms of hydrofoils provided for use on sail boats, most are mounted on the associated sail boats in a manner which greatly increases the effective beam of the sail boat or unnecessarily increases the draft of the sail boat. Further, various other forms of previously known water foils or hydrofoils designed for use on sail boats are constructed and/or mounted on the corresponding sail boats in a manner such that the maximum effectiveness of the hydrofoils may not be realized. Accordingly, a need exists for hydrofoils for use on sail boats which do not excessively increase the beam and/or draft of the sail boat, but which are operative to function in a highly efficient manner.

Examples of previously known hydrofoils using some of the basic structural and operational features of the instant invention are disclosed in my prior U.S. Pat. No. 3,763,811 as well as prior U.S. Pat. No. 1,356,300.

BRIEF DESCRIPTION OF THE INVENTION

This invention relates to a hydrofoil construction for sail boats which provides resistance to leeway and develops a righting moment to partially offset the upsetting moment caused by wind force acting upon the sail(s) and water forces acting upon a depending keel or centerboard of the sail boat. The invention consists of a pair of downwardly convergent foils extending from or near the surface of the water on opposite sides of the hull downwardly in a convergent manner to a keel, centerboard or strut depending downwardly from the hull. The orientation of the foils is such that when the hull is moving ahead (with no leeway), no hydrodynamic force, other than drag, is generated, but when a lateral component of motion (leeway) is experienced, a hydrodynamic force is developed on both the windward and leeward foils with force component perpendicular to the foils. The result is that the windward foil has a transverse as well as vertically downward component of force developed thereon and the leeward foil has a transverse as well as vertically upward component of force developed thereon. These components of forces acting together create a righting moment opposite in direction to the upsetting moment (caused by the transverse hydrodynamic forces below the water line coupled with the transverse aerodynamic forces above the water).

Each foil is basically flexible and is fixed or adjustable in angle of attack. Each foil may be either constant or varying in cross section, or chord length, and each foil may comprise a single foil element or a plurality of spaced foil elements.

The main object of this invention is to provide a hydrofoil construction for use on sail boats that will serve to generate a righting moment against the upsetting moment created by lateral wind and water forces when the associated boat is moving forward with a lateral component of motion, or leeway.

Another object of this invention is to provide a hydrofoil construction which may be readily adapted to various forms of sail boats.

Yet another object of this invention is to provide a hydrofoil construction which may be utilized in conjunction with sail boats including fixed keels as well as sail boats including upwardly retractable centerboards.

A further important object of this invention is to provide a hydrofoil construction including an adjustment feature which may be utilized to angularly adjust the angle of attack of the foils.

A final object of this invention to be specifically enumerated herein is to provide a hydrofoil construction in accordance with the preceding objects and which will conform to conventional forms of manufacture, be of simple construction and easy to install so as to provide a device that will be economically feasible, long lasting and relatively trouble free in installation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a side elevational view of sail boat including hydrofoils constructed in accordance with the present invention;

FIG. 2 is an enlarged transverse vertical sectional view taken substantially upon the plane indicated by the section line 2—2 of FIG. 1;

FIG. 3 is a set of four cross-sectional views indicating four different cross-sectional shapes and constructions of foils which may be utilized in the instant invention;

FIG. 4 is a schematic view illustrating the arrangement of forces acting upon the center strut and foils of a sail boat constructed in accordance with the present invention;

FIG. 5 is a fragmentary enlarged transverse vertical sectional view of a sail boat utilizing a modified form of foil construction of the instant invention;

FIG. 6 is a fragmentary transverse vertical sectional view illustrating the manner in which the lower ends of the foils illustrated in FIG. 5 may be anchored relative to the depending centerboard of the sail boat;

FIG. 7 is a fragmentary side elevational view of the lower end portion of the foil construction;

FIG. 8 is a fragmentary perspective view of the upper portion of the foil construction illustrated in FIG. 5;

FIG. 9 is a fragmentary enlarged vertical section view taken substantially upon the plane indicated by the section line 9—9 of FIG. 8;

FIG. 10 is a fragmentary perspective view of the upper portion of an adjustable form of hydrofoil construction;

FIG. 11 is a top plan view of a second form of adjustable hydrofoil construction;

FIG. 12 is a fragmentary side elevational view of a boat hull utilizing a downwardly tapering form of hydrofoil construction; and FIG. 13 is a side elevational view of a boat hull utilizing a tandem type of hydrofoil construction.

DETAILED DESCRIPTION OF THE INVENTION

Referring now more specifically to FIGS. 1 and 2 of the drawings, the numeral 10 generally designates a sail boat including a bottom 12 and upstanding sides 14 and 16. The sides 14 and 16 extend longitudinally of the boat 10 between the front and rear ends 18 and 20 thereof and it may be seen that the boat 10 includes a mast 22 from which a sail 24 is supported.

The boat 10 includes three longitudinally spaced depending stationary struts, dagger boards or centerboards 26, 28 and 30, and each strut 26, 28 and 30 has a pair of foils 32 and 34 operatively associated therewith.

Each of the foils 32 and 34 comprises an elongated strip 36, see FIG. 3 including parallel leading and trailing edges 38 and 40 as well as planar and parallel opposite side faces 42 and 44. The lower end of each foil 32 and 34 is anchored to the lower end of the corresponding strut as at 46 and the foils 32 and 34 diverge upwardly from the lower end of the corresponding strut and are anchored at their upper ends to outwardly projecting supports 48 and 50 projecting outwardly from the upper margin of portions of the sides 14 and 16. The foils 32 and 34 are flexible, but are tensioned in substantially straight condition extending between the supports 48 and 50 and the lower end of the strut 30 with those portions of the foils 32 and 34 extending between the strut 30 and the supports 48 and 50 completely free of support from the boat 10. However, certain shaped hulls may use foils attached directly to the hull sides in lieu of the supports 48 and 50.

As may be seen in the upper portion of FIG. 3, the foils 32 and 34 may each also comprise a single strip 52 of flexible material having a transverse cross sectional shape similar to an airfoil. In addition, as may be seen in a lower portion of FIG. 3 each of the foils 32 and 34 may further comprise a plurality of strips 54 similar to the strip 36, but disposed in surface-to-surface contacting relation and enclosed within a body 56 having a transverse cross-sectional shape similar to an air foil. Further, in the lowest portion of FIG. 3 it may be seen that each foil 32 and 34 may comprise a strip 58 of flexible material having a transverse cross-sectional shape similar to an airfoil, but which may be flat, and including elongated tension members 60 and 62 embedded therein and extending along the leading and trailing edge portions of the strip 58.

With attention now invited more specifically to FIG. 4 of the drawings, the strut 30 and the foils 32 and 34 are schematically illustrated. Assuming the boat 10 is moving forward and in a lateral leeward direction to the left as viewed in FIG. 4 force Fs comprises a component of the upsetting force acting upon the strut 30. Force Flh comprises the horizontal component of force acting upon the leeward foil 32, FlV comprises the vertical component of force acting upon the leeward foil 32 and Rl comprises the resultant force acting upon the leeward foil in a direction normal thereto. Further, Fwh comprises the horizontal component of force acting upon the windward foil 34, Fwv comprises the vertical component of force acting upon the windward foil 34 and force Rw comprises the resultant force acting upon the windward foil normal thereto. The horizontal hydrodynamic force components, Flh, Fs and Fwh, coupled with the opposing aerodynamic force on the sail 24 constitute an upsetting moment applied to the boat 10. The opposing vertical hydrodynamic force components Flv and Fwv, separated by distance 1 constitute a dynamic righting moment which partially offsets the upsetting moment referred to above.

With attention again invited to FIG. 1 of the drawings, the strut 26 and 30 are spaced longitudinally of the boat 10 and the strut 28 is spaced intermediate the struts 26 and 30. The boat 10 may utilize only the foils 32 and 34 supported from the strut 28 or only the front and rear pairs of foils supported from the struts 26 and 30.

Referring now more specifically to FIG. 5 of the drawings, the numeral 70 generally designates a sail boat including an upwardly retractable strut or dagger board 72 which may be retracted upwardly relative to the boat 70 into a well or housing 74 within the boat 70. A removable pin 76, or other suitable means, is provided and may be utilized to retain the strut 72 in its lowered position illustrated in solid lines in FIG. 5 and the pin 76 may be engaged through a lower transverse bore 78 formed in the strut 72 in order to retain the latter in the upwardly retracted position thereof illustrated phantom lines in FIG. 5.

The boat 70 includes a pair of opposite side foils 82 and 84 corresponding to the foils 32 and 34 and which have the lower ends thereof clamped to opposite side portions of the lower end of the strut 72 by means of nacelle halves 86 clampingly engaging the lower end of the strut 72 therebetween by means of fasteners 88 secured therethrough. The boat 70 has a pair of parallel bars 90 extending between and beyond its sides and corresponding ends of the bars 90 are interconnected by means of a member 92 extending and secured therebetween. The upper ends of the foils 82 are deflected around and inwardly from the center portions of the members 92 between the corresponding ends of the bars 90 and are secured to a pair of slide blocks 94 received between and slidingly engaged with the corresponding ends of the bars 90. The bars 90 have longitudinally spaced vertical bores 96 formed therethrough and the slide blocks 94 have vertical bores 98 formed therethrough registerable with selected pairs of corresponding bores 96. A pair of anchor pins 100 is provided for each slide block 94 and may be utilized to secure the slide block in adjusted position along the bars 90 in order to inwardly retract the upper ends of the foils 82 and 84 when the strut 72 is retained in the uppermost position thereof illustrated in phantom lines in FIG. 5. When the strut 72 is anchored in the upper position and the upper ends of the foils 82 and 84 are inwardly retracted, the foils 82 and 84 have at least the mid portions thereof engaged with and overlying the opposing outer surfaces of the boat 70 and deflected so as to conform to the contour of the boat 70.

With attention now invited more specifically to FIG. 10 of the drawings it may be seen that the bars 90 may be replaced by bars 102 and 104. The bar 102 may be stationarily supported from the corresponding boat and the bar 104 is supported from the bar 102 by means of parallelogram links 106 having their opposite ends pivotally attached to the bars 102 and 104. In addition, a lever handle 108 has longitudinally spaced portions thereof pivotally attached to the bars 102 and 104. When the bars 102 and 104 are utilized, foils 112 and 114 corresponding to the foils 32 and 34 have their upper ends anchored to the mid portions of the corresponding links 106 whereby the lever handle 108 may be angularly displaced so as to effect angular displacement of the upper end portions of the foils 112 and 114 about upstanding axes thereby varying the angle of attack of the foils 112 and 114. The adjustment of the angle of attack of the foils 112 and 114 may be utilized to vary leeward movement of the associated boat.

With reference now more specifically to FIG. 11 of the drawings, it may be seen that the bar 102 may be replaced by a bar 116 and that the links 106 may be replaced by pivoted cross members 118 to which the upper ends of foils corresponding to the foils 82 and 84 may be attached. The cross members 118 include a tension member 120 including an elastic section 124 and two end sections 125 and 126 extending and connected between one pair of corresponding ends thereof and a tension member 122 including an adjustable length turnbuckle 123 connected between the other pair of ends of the members 118. Also, a lever handle 124 corresponding to the lever handle 108 may be utilized. Thus, the components illustrated in FIG. 11 may be utilized in the same manner as the assemblage illustrated in FIG. 10, the FIG. 11 structure being somewhat more adjustable and the mid portions of the tension members 120 and 122 being anchored relative to the lever handle 127 by means of U-clamps 128.

The foils 32, 34, the foils 82 and 84 and the foils 112 and 114 include single foil elements having parallel leading and trailing edges. From FIG. 12 of the drawings it may be seen that foils 132 having downwardly convergent leading and trailing edges 134 and 136 may be utilized in lieu of the previously described foils. Further, from FIG. 13 it may be seen that each foil may comprise a pair of tandem foil elements 138 and 140 so as to define a slotted foil. Of course, each form of foil illustrated in FIG. 3 may be utilized in conjunction with the structures illustrated in FIGS. 8, 10 and 11. In addition, the strucures illustrated in FIGS. 10 and 11 may be utilized in conjunction with any or all of the foils illustrated in FIG. 1 and also with the foils illustrated in FIGS. 12 and 13.

Also, the boat 10 may be provided with only the strut 28 and its foils 32 and 34, the struts 26 and 30 and their foils, or all three struts 26, 28 and 30 and their foils. Further, additional struts and foils may be provided, if desired, and a single strut may be used for all sets of foils 32 and 34.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a boat having front and rear ends, a bottom and upwardly projecting sides extending upwardly to an elevation spaced above the static water line of said boat, a depending central strut projecting downwardly from said bottom, a pair of elongated, longitudinally straight and downwardly convergent opposite side flexible foils including leading and trailing longitudinal edges facing in front and rear directions, respectively, of said boat, first anchor means anchoring the lower ends of said foils to the lower end portion of said strut, and second anchor means anchoring the upper end portions of said foils to upper portions of the corresponding sides of said boat above said static waterline, said foils extending lengthwise along generally straight paths and being free of support from said boat and each other intermediate said first and second anchor means and thereby being free to twist and bow, slightly, between said first and second anchor means.

2. The combination of claim 1 wherein said second anchor means includes adjustment means operative to adjustably angularly displace said upper end portion of said foils about upstanding axes.

3. The combination of claim 2 wherein said adjustment means includes means operative to simultaneously equally and oppositely angularly displace said upper end portions about said upstanding axes.

4. The combination of claim 1 including means supporting a said strut from said boat for upward retraction relative thereto with the lower end portion of said strut adjacent the bottom of said boat, said foils being stiff but bendable, said second anchor means including means operative to upwardly retract said upper end portions theretoward and said foils being bendable to conform to at least the transverse lower portions of the outline of said boat on opposite sides of said strut for overlying at least those portions of the outer surfaces of said hull opposing the lower portions of said foils.

5. The combination of claim 1 wherein said boat includes front and rear pairs of opposite side foils spaced longitudinally of said boat.

6. The combination of claim 5 wherein said boat includes a center pair of opposite side foils spaced longitudinally of said boat between said front and rear pairs of foils.

7. The combination of claim 1 wherein each of said foils comprises a pair of spaced leading and trailing foil elements.

8. The combination of claim 1 wherein the leading and trailing edges of each of said foils generally parallel each other.

9. The combination of claim 1 wherein the leading and trailing edges of each of said foils are convergent toward one pair of corresponding ends thereof.

10. The combination of claim 1 wherein the leading and trailing edges of each foil are downwardly convergent.

11. The combination of claim 1 wherein said strut is fixed.

12. The combination of claim 1 wherein each of said foils comprises a single strip member including generally parallel and planar opposite sides faces.

13. The combination of claim 1 wherein each of said foils comprises a single strip member having an airfoil cross sectional shape.

14. The combination of claim 1 wherein each of said foils includes a plurality of strip members enclosed within a body having an airfoil cross sectional shape.

15. The combination of claim 1 wherein each of said foils includes a main body portion having an airfoil cross sectional shape and including elongated tension members embedded therein extending along the leading and trailing edge portions thereof.

* * * * *